US008404329B2

(12) United States Patent
Wüstefeld

(10) Patent No.: US 8,404,329 B2
(45) Date of Patent: Mar. 26, 2013

(54) SUPPORT STRUCTURE FOR LIGHT-WEIGHT CONSTRUCTION ELEMENTS

(76) Inventor: Jens-Hagen Wüstefeld, Starnberg (DE)

( * ) Notice: Subject to any disclaimer, the term of this patent is extended or adjusted under 35 U.S.C. 154(b) by 437 days.

(21) Appl. No.: 12/670,087

(22) PCT Filed: Aug. 18, 2008

(86) PCT No.: PCT/DE2008/001376

§ 371 (c)(1),
(2), (4) Date: Jan. 21, 2010

(87) PCT Pub. No.: WO2009/024141

PCT Pub. Date: Feb. 26, 2009

(65) Prior Publication Data

US 2010/0196657 A1 Aug. 5, 2010

(30) Foreign Application Priority Data

Aug. 18, 2007 (DE) ..... 20 2007 011 599 U

(51) Int. Cl.
*B32B 3/24* (2006.01)

(52) U.S. Cl. ..... 428/136; 52/668

(58) Field of Classification Search ..... 428/136; 52/668

See application file for complete search history.

(56) References Cited

U.S. PATENT DOCUMENTS

| | | | | |
|---|---|---|---|---|
| 1,611,316 | A * | 12/1926 | Nagin | 52/668 |
| 1,740,219 | A * | 12/1929 | Berson | 52/668 |
| 5,157,892 | A | 10/1992 | Ryther | |
| 6,148,834 | A * | 11/2000 | Grooms, Sr. | 135/116 |

FOREIGN PATENT DOCUMENTS

| | | |
|---|---|---|
| DE | 7 608 866 U | 7/1975 |
| DE | 25 26 114 A1 | 1/1976 |
| DE | 199 22 295 C1 | 7/2000 |
| GB | 929494 | 6/1963 |

OTHER PUBLICATIONS

Search Report issued Sep. 13, 2007 by the German Patent Office in German Utility Model Application 20 2007 011 599.7.

International Search Report for corresponding foreign application No. PCT/DE2008/001376, filed Aug. 18, 2008.

Written Opinion of the International Searching Authority for corresponding foreign application No. PCT/DE2008/001376, filed Aug. 18, 2008.

* cited by examiner

*Primary Examiner* — William P Watkins, III

(74) *Attorney, Agent, or Firm* — Hamre, Schumann, Mueller & Larson, P.C.

(57) ABSTRACT

Support structure for light-weight construction elements which is consisting of elongate strips (10; 110; 210) of a strong material, wherein each strip (10; 110) is provided with slits (14) starting out from one of its longitudinal edges (12), the width of which is slightly larger than the thickness of the material and, wherein alternatingly in the longitudinal direction of the strip (10; 110; 210) the slits (14) are diagonally extending forwardly and diagonally backwardly and, wherein the individual strips (10; 110; 210) by means of the slits (14) are inserted into each other in such a way that the longitudinal directions of the strips (10; 110; 210) inserted into each other each are perpendicularly positioned with respect to each other, as well as a method for producing such a support structure.

9 Claims, 8 Drawing Sheets

SUPPORT STRUCTURE FOR LIGHT-WEIGHT CONSTRUCTION ELEMENTS

Figure 1:
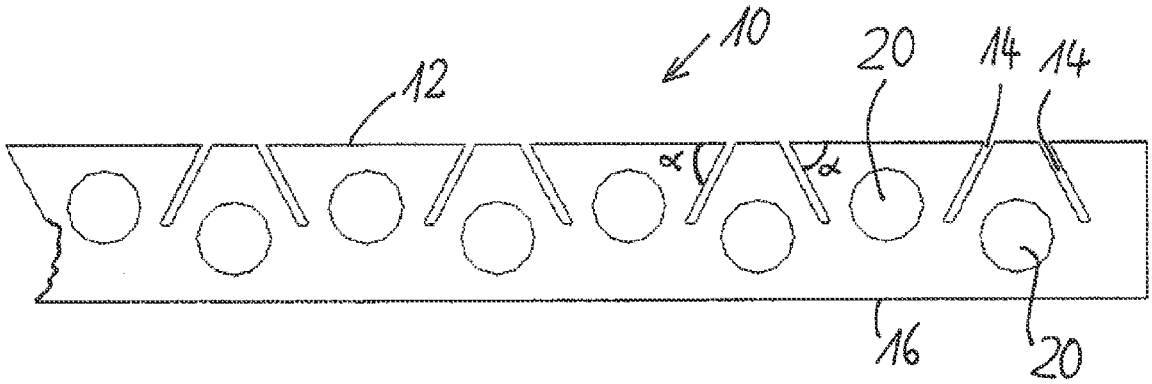

The present invention is relating to a support structure for light-weight construction elements, which is consisting of elongate strips of a strong material, as well as to a method for the production of such a support structure.

Light-weight construction elements, as these for example are used in the aeronautic industry, in the vehicle construction industry or in connection with the construction of racing yachts, are usually consisting of two extremely thin cover plates being by themselves hardly able to support loads, which are forming the respective outer surface of the light-weight construction elements and a support structure positioned there-between. Such support structure has to be as light-weight as possible and simultaneously as strong as possible and additionally has to support the cover plates which by themselves do not have any load bearing capacities at as many points as possible. Such a support structure therefore usually has to be produced as a spatial, three-dimensional element. In connection with the constructions known up to today, this is extremely expensive and therefore such light-weight construction elements are extremely expensive.

Starting out from this prior art, it is the task to be solved by the present invention to provide for such a support structure which extremely simple can be constructed from simple construction elements as well as a method for building such a support structure.

According to the invention, this task is solved by the features that the support structure is consisting of elongate strips of a strong material and that each strip is provided with slits starting out from one of its longitudinal edges, the width of which is slightly larger than the thickness of the material and which alternatingly in the longitudinal direction of the strip are extending diagonally in the forward direction and diagonally in the backward direction, wherein the individual strips by means of the slits are fitted into one other in such a way that the longitudinal directions of the strips fitted into one other each are extending perpendicular to each other.

According to the invention therefore here a three-dimensional spatial support structure is produced from simple metal sheet strips which merely have to be provided with corresponding slits by a punching procedure. Due to the diagonal extension of the slits it is ensured that the individual metal sheet strips are extending in an optimal angle to each other to be able to take maximal loads for a defined material weight.

To obtain an optimal support of the thin cover plates, it is preferred that the depth of the slits is chosen such that the longitudinal sides of the strips extending perpendicularly to each other are contacting one surface. This then is the surface of the light-weight construction element which is formed by the contour of the cover plates. In combination with a corresponding design of the metal sheet strips, in this connection even a curved surface and what is more tubes or profiles can be produced.

For an optimal distribution of forces, it is especially preferred to position the slits in such a way that these in their prolongation together with the longitudinal edge, on which they are starting out from, approximately are forming an equilateral triangle. In this way, the support structure formed from such metal sheet strips then is consisting of optimal pyramids or frustrums of pyramids the lateral faces of which are equilateral triangles.

For a further saving of weight, preferably in the centre of the equilateral triangle a circular cut-out or punch-out can be provided.

A further optimizing of the distribution of forces preferably can be achieved by the features that several slits which are forming equilateral triangles with other slits and with the longitudinal edge are positioned in such a distance from each other that they together with the longitudinal edge from which they are starting out from, too, approximately are forming a further equilateral triangle.

A further saving of weight then preferably can be achieved by the feature that in the centre of the further equilateral triangle a circular punch-out is provided.

A especially preferred method for the production of such a support structure according to the invention is consisting in the feature that the strips extending in the longitudinal direction firstly all are positioned in parallel to each other such that their slits are positioned on the same height and thereafter the strips extending in the transverse direction are inserted into the slits of the strips extending in the longitudinal direction.

In this connection, it is especially preferred to position the strips extending in the longitudinal direction straight-away in distances which are corresponding to the distances of the slits in the strips extending in the transverse direction. In this way, a continuous production of the support structure according to the invention becomes possible due to the fact that the respective strips easily can be turned and bent in such a way that they during this manufacturing process can lock into each other by means of their corresponding slits.

Alternatively to the above, the possibility is existing, too, to position the strips extending in the longitudinal direction in a package and thereafter insert the strips extending in the transverse direction followed by the procedure that the individual strips extending in the longitudinal direction are shifted along the inserted strips extending in the transverse direction up to the corresponding slits provided in the strips extending in the transverse direction.

Figure 2:
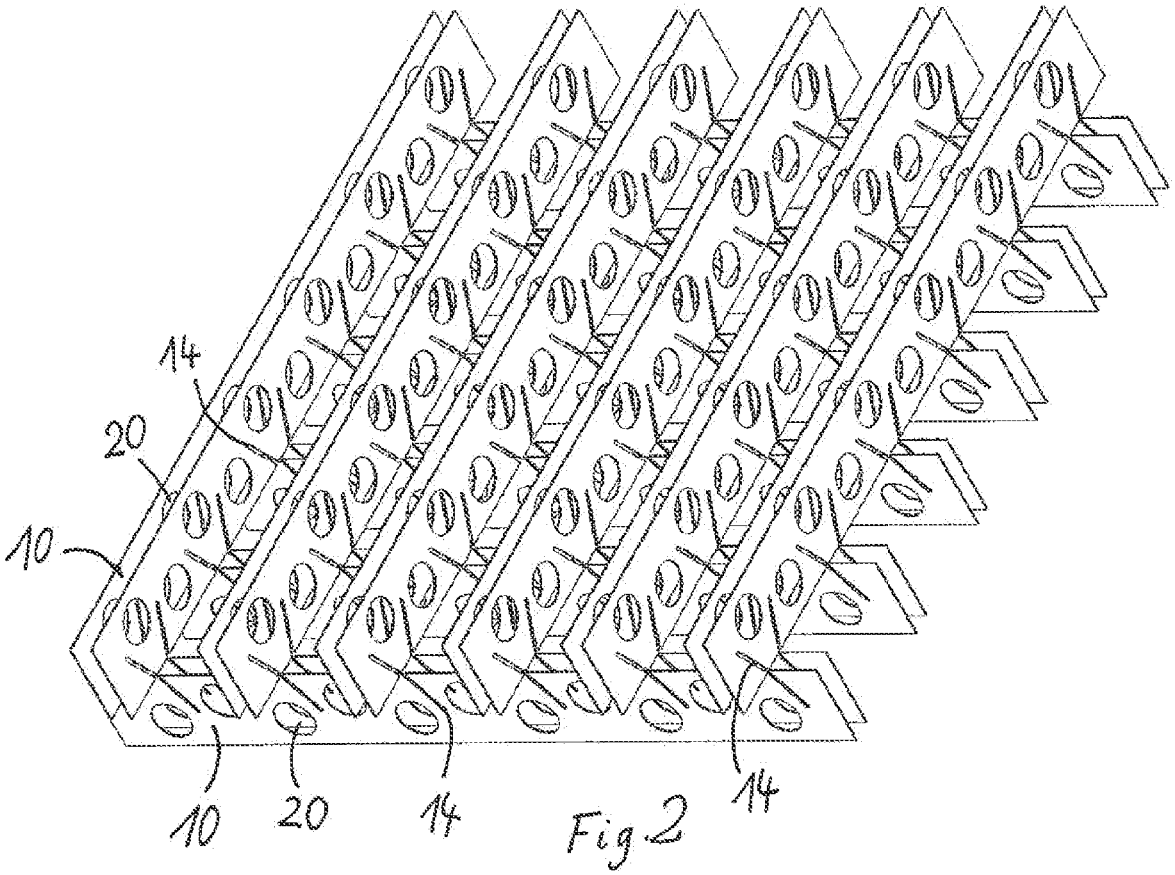
Figure 3:
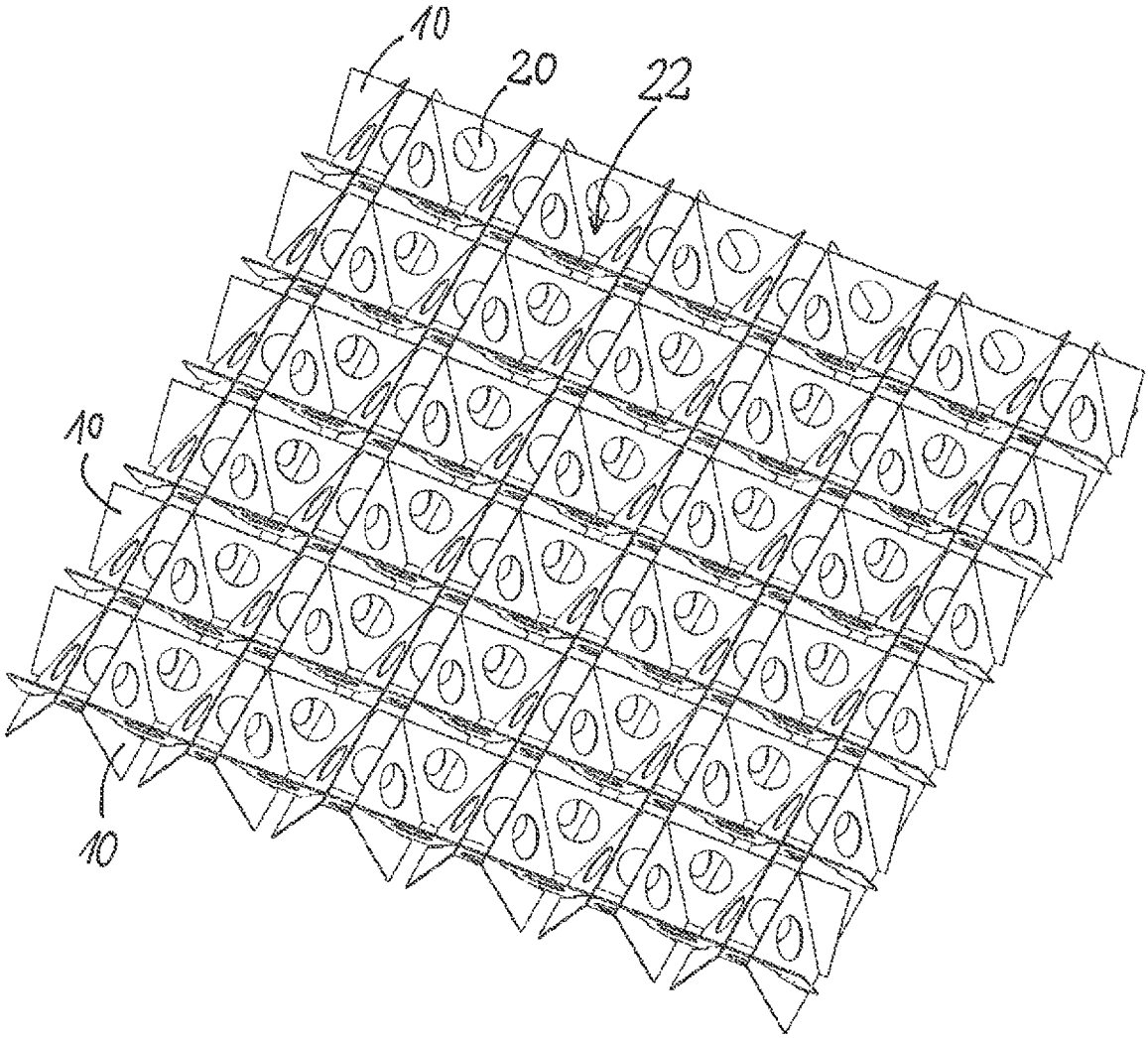
Figure 4:
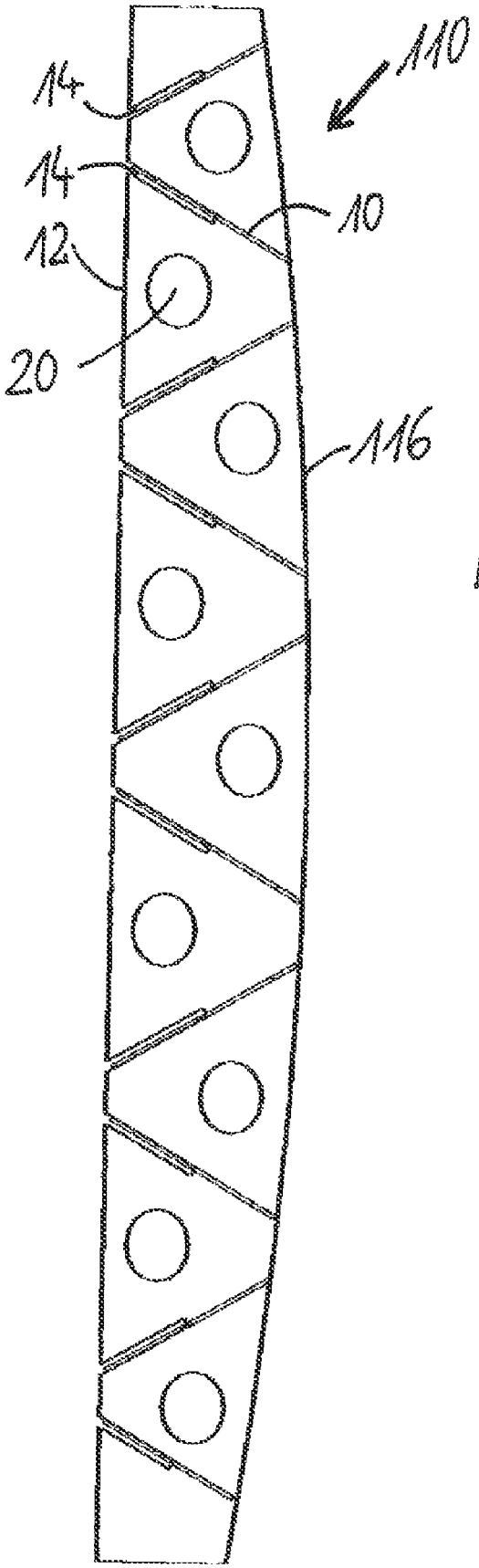
Figure 5:
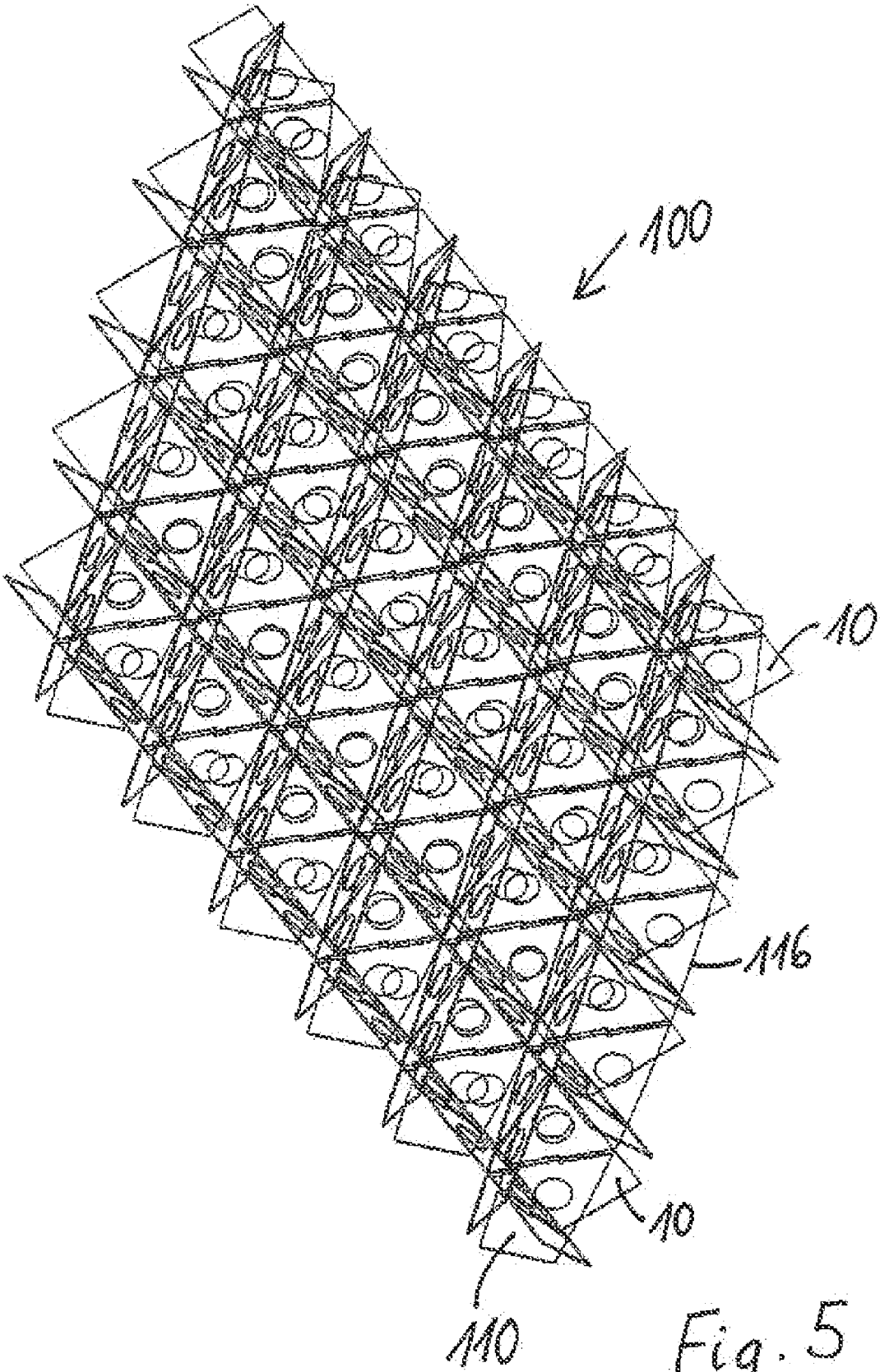
Figure 6:
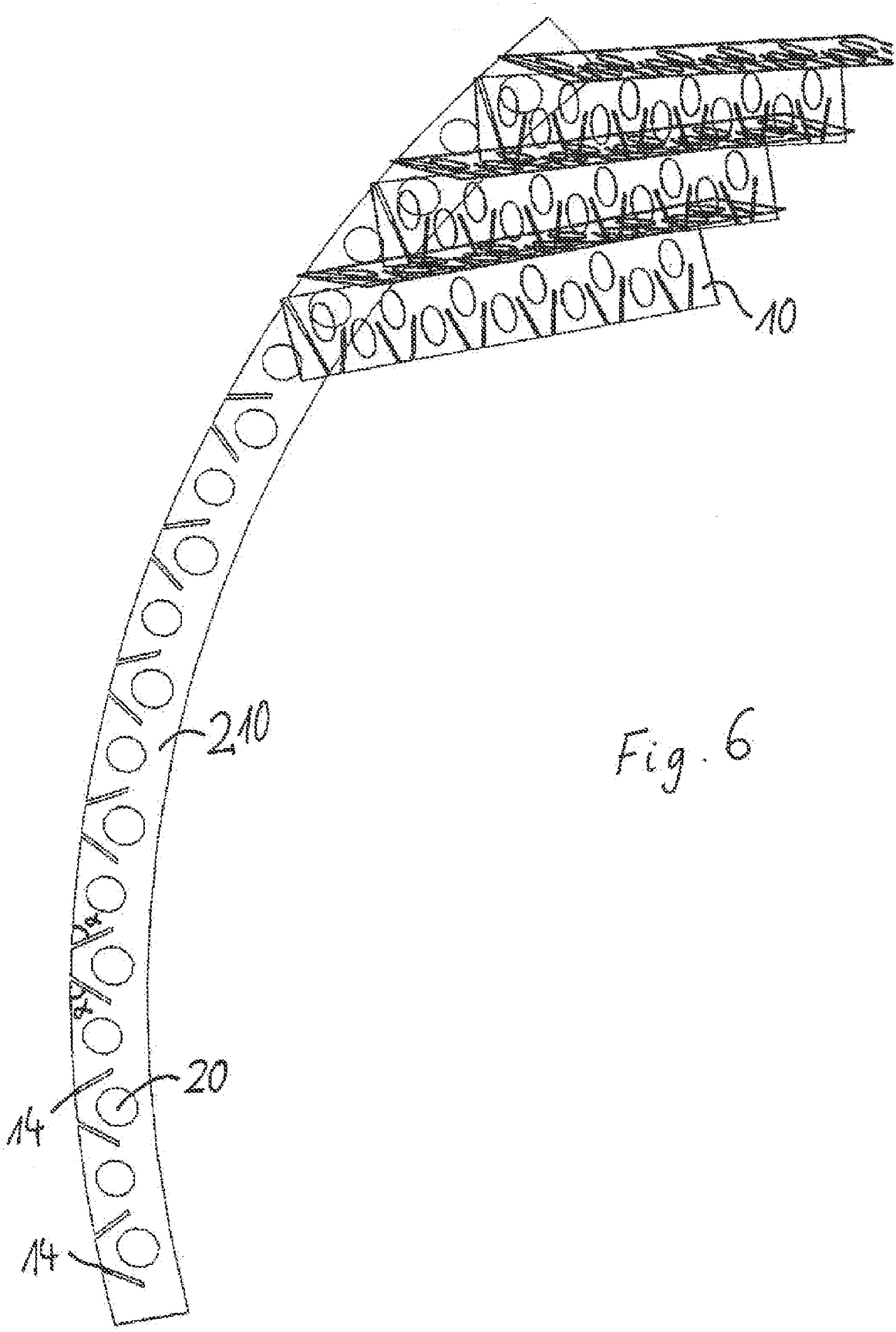
Figure 7:
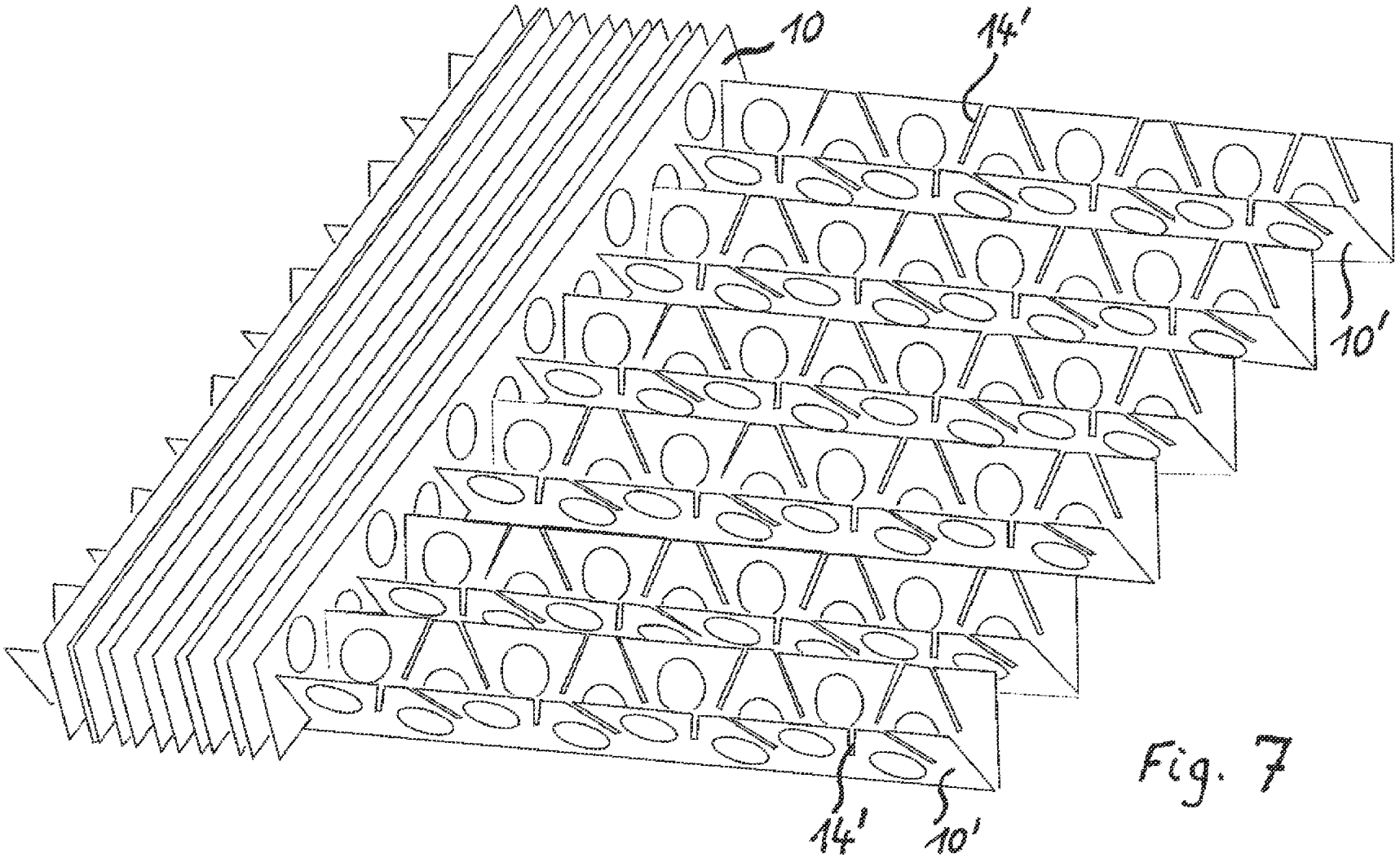
Figure 8:
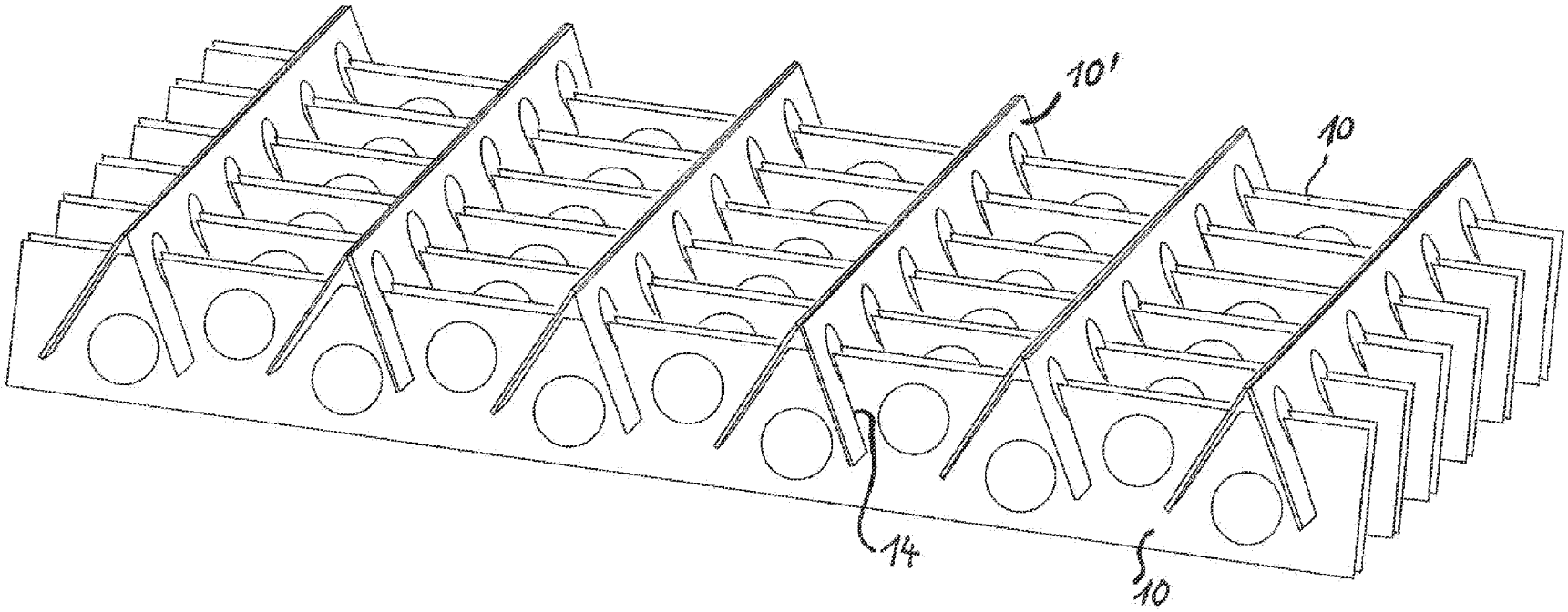

In the following, the present invention is more detailedly disclosed with reference to exemplary embodiments shown in the drawings. In the drawings show:

FIG. 1 a section of the metal sheet strip for the support structure according to the invention;

FIG. 2 the corresponding support structure before the final mounting in an exploded view;

FIG. 3 the finished support structure according to FIG. 2;

FIG. 4 a further embodiment of a metal sheet strip according to the invention for a lenticularly curved light-weight construction element;

FIG. 5 a corresponding light-weight construction element having a curved surface;

FIG. 6 a support structure according to the invention for a tubular lightweight construction element;

FIG. 7 a method for the production of a support structure according to the invention, wherein the strips extending in the longitudinal direction firstly are positioned in a package and, FIG. 8 a method for the production of a support structure according to the invention in which the strips extending in the longitudinal direction straight-away are positioned in such distances which are corresponding to the distances of the slits in the metal sheet strips extending in the transverse direction.

FIG. 1 is showing a metal sheet strip from which a support structure for a plane light-weight construction element can be produced. This metal sheet strip 10 on its in the drawing upper longitudinal edge 12 is having slits 14 the width of which is slightly larger than the thickness of the material of the metal sheet strip 10 and which alternatingly in the longitudinal direction of the strip 10 are extending diagonally forward and diagonally backward. Doing so, they are forming with the longitudinal edge 12 each an angle $\alpha$ of about 60° in the forward direction or in the backward direction. If one prolongs the slits 14 mentally up to the opposite longitudinal edge 16 of the strip 10, then they are forming a series of equilateral triangles having a truncated apex which each is formed by one of the longitudinal edges 12 or 16, respectively. In the centre of each of these imaginary equilateral triangles a circular punch-out 20 is positioned. The same is serving the saving of weight.

FIG. 2 now is showing how from a plurality of such individual strips 10 a parallel-epipedal support structure is created. To this end, the individual strips 10 with their slits 14 each are inserted into corresponding slits 14 provided in a further strip 10 being perpendicularly positioned thereto.

FIG. 3 then is showing the final result of these mounting procedures, wherein the strips 10 cross-wisely inserted into each other due to the respective angular position of the slits 14 are forming a structure of frustrums of a pyramid positioned in a small distance respective to each other, the lateral faces of which each are joined by means of the continuous strip 10 with the lateral faces of the each respective adjacent frustrums of pyramids. This structure is having an optimal strength.

FIG. 4 is showing a metal sheet strip 110 according to a further embodiment of the present invention. This metal sheet strip 110 is having, too, a straightly extending longitudinal edge 12 which again is provided with the slits 14 sloping by an angle $\alpha$ of about 60° diagonally in the longitudinal direction and against the longitudinal direction. The opposed longitudinal edge 116 in the present case however is not straight but instead curved or designed sweeping to provide for such a support structure for a curved lightweight construction element, for example to form the wing for an aeroplane. Further, here in the slits 14 and extending further beyond the same already the further strips 10 are indicated which are to be mounted perpendicularly on the strips 110. In the present case these basically have to be designed in the same way as the strip 10 shown in FIG. 1, wherein however, as it easily can be learned from the drawing, the width thereof has to be different in adaptation to the curvature of the longitudinal edge 116 of the strip 110 to form a correctly curved surface. Additionally in the present FIG. 4 it nicely can be seen how in the central area the slits 14 prolonged by the differently broad strips 10 are forming equilateral triangles with a truncated apex.

FIG. 5 is showing the support structure 100 produced from the curved strips 110 as well as from normal straight strips 10 of different width for a corresponding light-weight construction element having a curved surface.

FIG. 6 finally is showing a further embodiment of the invention in a support structure for a tubular light-weight construction element which for example can serve as the fuselage of an aero-plane or as the hull of racing yachts. To this end, the strip 210 extending as the rib is designed curved. This strip, too, however is having the slits 14 according to the invention extending in the longitudinal direction and against the longitudinal direction of the strip 210 which again each are forming an angle $\alpha$ of 60° with the exterior side of the strip 210. In this strip 210, too, corresponding punch-outs 20 can be provided to save weight. To form a corresponding tubular support structure, the individual curved strips 10 then again are connected with normal strips 10 according to the invention as these are shown in FIG. 1.

According to the invention, therefore very complex shaped light-weight construction support structures can be manufactured from very few basic elements, namely, the strips 10; 110; 210 which easily can be produced. The strips 10; 110; 210 in this connection can be produced from any deliberate strong material, preferably however from steel, light alloys or plastics. The connection of the individual strips 10; 110; 210 to each other and to the cover plates can be performed by all known connecting techniques like gluing, soldering, welding, riveting, folding, clinching.

According to the invention, the finished light-weight construction element not only can be constructed from two cover plates and a support structure in between but instead, too, from several such layers.

The strips 10; 110; 210 can be produced in an extremely simple way by a singular punching procedure from continuous bands of the respective material. According to the invention then merely these strips 10; 110; 210 has to be inserted cross-wise into each other such that a spatial structure is created consisting of frustrums of pyramids which is having an optimal strength as a support structure combined with a lowest possible weight. The preferred width of the slits 14 arises from the thickness of the material and from the insertion angle of the strips 10; 110; 210 each corresponding to the material used and the relation of the surfaces and angles it can be necessary to broaden the slits or to include radii which possibly, too, subsequently filled with filling material or filling pieces with the purpose to bridge the same.

The strips 10; 110; 210 to save further weight can be pierced (see the punch-out 20 in the exemplary embodiments) perforated and/or shaped.

FIG. 7 is showing an especially preferred method for producing a support structure according to the invention. In this connection, the strips 10 extending in the longitudinal direction firstly all together are positioned parallel to each other in such a way that the slits thereof are positioned on the same height and the strips 10' extending in the transverse direction thereafter are inserted into the slits of the strips 10 extending in the longitudinal direction. In the method shown in FIG. 7, the strips 10 extending in the longitudinal direction here firstly are positioned in a package. Thereafter the strips 10' extending in the transverse direction are inserted and thereafter the individual strips 10 extending in the longitudinal direction are shifted along the inserted strips 10 extending in the transverse direction up to the respective slits 14' in the strips 10' extending in the transverse direction.

FIG. 8 is showing a slightly modified method of production for the support structure according to the invention in which the strips 10 extending in the longitudinal direction are positioned straight-away in distances which are corresponding to the distances of the slits 14' in the strips 10' extending in the transverse direction. Thereafter again the strips 10' extending in the transverse direction are inserted into the slits 14 in the strips 10 extending in the longitudinal direction. If thereafter the respective corresponding strips extending in the transverse direction and in the longitudinal direction are shifted into one other, then unavoidably due to the geometric shape of the corresponding strips 10, 10' the support structure according to the invention is formed. This in this connection is independent from whether a starting configuration according to FIG. 7 or according to FIG. 8 has been chosen.

Obviously the support structure according to the invention can be assembled from the described strips 10 by many other production methods.

The invention claimed is:

1. Support structure for light-weight construction elements consisting of elongate strips of a strong material, wherein each strip is provided with straight slits starting out from one of its longitudinal edges the width thereof is slightly larger than the thickness of the material and which alternatingly in the longitudinal direction are diagonally extending forwardly and diagonally extending backwardly and that the individual strips by using the slits are inserted into each other in such a way that the longitudinal directions of the slits inserted into each other each are extending perpendicularly to each other.

2. Support structure according to claim 1, wherein the depth of the slits is chosen such that the longitudinal edges of the strips positioned perpendicularly to each other are contacting one surface.

3. Support structure according to claim 1, wherein the slits are positioned such that the same in the prolongation thereof together with the longitudinal edge from which they are starting out approximately are forming an equilateral triangle.

4. Support structure according to claim 3, wherein in the centre of the equilateral triangle a punch-out is provided.

5. Support structure according to claim 3, wherein different slits which together with other slits and with the longitudinal edge from which they are starting out from are forming equilateral triangles are positioned from each other in such a distance that they, too, together with the other longitudinal edge approximately are forming a further equilateral triangle.

6. Support structure according to claim 5, wherein in the centre of the further equilateral triangle a punch-out is provided.

7. A method for the production of a support structure according to claim 1, wherein the strips extending in the longitudinal direction firstly all together are positioned parallel to each other in such a way that the slits are positioned on the same right and that the strips extending in the transverse direction thereafter are inserted into the slits of the strips extending in the longitudinal direction.

8. A method according to claim 7, wherein the strips extending in the longitudinal direction immediately are positioned in distances which are corresponding to the distances between the slits of the strips extending in the transverse direction.

9. A method according to claim 7, wherein the strips extending in the longitudinal direction are positioned in a package, that the strips extending in the transverse direction thereafter are inserted and then the individual strips extending in the longitudinal direction are shifted along the inserted strips extending in the transverse direction up to the corresponding slits in the strips extending in the transverse direction.

* * * * *